US010755657B2

(12) United States Patent
Kim

(10) Patent No.: US 10,755,657 B2
(45) Date of Patent: Aug. 25, 2020

(54) ENERGY RETRIEVABLE DATA DRIVER, DISPLAY, AND METHOD OF DRIVING DISPLAY

(71) Applicant: INNOAXIS CO., LTD, Namyangju-si, Gyeonggi-do (KR)

(72) Inventor: Hwi-Cheol Kim, Seoul (KR)

(73) Assignee: INNOAXIS CO., LTD, Namyangju-si, Gyeonggi-Do (KR)

( * ) Notice: Subject to any disclaimer, the term of this patent is extended or adjusted under 35 U.S.C. 154(b) by 343 days.

(21) Appl. No.: 15/054,960

(22) Filed: Feb. 26, 2016

(65) Prior Publication Data

US 2016/0260384 A1 Sep. 8, 2016

(30) Foreign Application Priority Data

Mar. 3, 2015 (KR) ..... 10-2015-0029644

(51) Int. Cl.
*G09G 3/36* (2006.01)
*G09G 3/20* (2006.01)

(52) U.S. Cl.
CPC ..... *G09G 3/3648* (2013.01); *G09G 3/20* (2013.01); *G09G 2310/0275* (2013.01); *G09G 2320/0271* (2013.01); *G09G 2320/0276* (2013.01); *G09G 2320/0673* (2013.01); *G09G 2330/021* (2013.01); *G09G 2330/023* (2013.01); *G09G 2330/028* (2013.01)

(58) Field of Classification Search
CPC ..... G09G 3/3648; G09G 3/20; G09G 2310/0275; G09G 2320/0271; G09G 2320/0276; G09G 2320/0673; G09G 2330/021; G09G 2330/023; G09G 2330/028; G09G 3/3685
USPC ..... 345/211
See application file for complete search history.

(56) References Cited

U.S. PATENT DOCUMENTS

2006/0061410 A1* 3/2006 Chiu ..... H02M 3/073 327/536
2006/0274014 A1 12/2006 Fujikura
(Continued)

FOREIGN PATENT DOCUMENTS

CN 1877687 A 12/2006
CN 102122482 A 7/2011
(Continued)

OTHER PUBLICATIONS

Chinese Office Action for related CN Application No. 201610121015.2 dated Jan. 30, 2018 from Chinese Patent Office.

*Primary Examiner* — Amare Mengistu
*Assistant Examiner* — Gloryvid Figueroa-Gibson
(74) *Attorney, Agent, or Firm* — Paratus Law Group, PLLC

(57) ABSTRACT

Disclosed are a data driver, a display, and a method of driving a display. The data driver for driving a data line which is a capacitive load having one end electrically connected to a unit pixel includes an energy retrieving unit configured to drive the data line by applying a voltage to the data line, and a data driving unit configured to finely tune a voltage and drive the data line with an end voltage. The energy retrieving unit retrieves energy charged up in the data line in stages by driving the data line with voltages from a start voltage to the end voltage through an intermediate voltage.

16 Claims, 8 Drawing Sheets

(56) References Cited

U.S. PATENT DOCUMENTS

| | | | | |
|---|---|---|---|---|
| 2008/0100603 | A1* | 5/2008 | Matsuda | G09G 3/3688 345/205 |
| 2008/0273007 | A1* | 11/2008 | Ng | G02F 1/167 345/107 |
| 2012/0169697 | A1 | 7/2012 | Chang et al. | |

FOREIGN PATENT DOCUMENTS

| | | | |
|---|---|---|---|
| CN | 103886822 | A | 6/2014 |
| CN | 104157258 | A | 11/2014 |
| KR | 10-2001-0077740 | A | 8/2001 |

* cited by examiner

ENERGY RETRIEVABLE DATA DRIVER, DISPLAY, AND METHOD OF DRIVING DISPLAY

CROSS-REFERENCE TO RELATED APPLICATION

This application claims priority to Korean Patent Application No. 10-2015-0029644, filed on Mar. 3, 2015, the disclosure of which is incorporated herein by reference in its entirety.

BACKGROUND

1. Field of the Invention

The present invention relates to an energy retrievable data driver, an energy retrievable display, and an energy retrievable method of driving a display.

2. Discussion of Related Art

A display divides a black-and-white or color image into pixels, loads screen information into each pixel and thereby display the image. A color display system generally displays each pixel of an image in the three primary colors of red, green and blue (RGB). An actual display requires a light source and it is possible to depend on a backlight as in a liquid crystal display (LCD) or use devices whose pixels self-emit light such as an organic light emitting diodes (OLED).

Power consumption in a display system may be roughly classified into the following three types: power consumed by a timing controller which converts a display source input for driving pixels into data required for driving a screen, power consumed by a driver integrated circuit (IC) which drives the pixels, and power consumed by a display to emit light. Among these, the last power consumption is the largest and determined by the light source used. In the case of an OLED display, the last power consumption is dependent on screen brightness data and so on.

The second largest power is consumed by the driver IC. A display system with a quarter high-definition (QHD) resolution has 2560×1440 pixels, and the actual number of channels is 2560*3=7680 because each pixel has the three colors of RGB. In practice, it is impossible to manufacture a single driver IC having such a large number of channels, and thus a system is configured with a plurality of easily manufactured driver ICs having a number of channels such as 720 channels or 960 channels. When a display system uses driver ICs having 960 channels, a total of eight ICs are required. A large-scale display in accordance with a recent trend has a resistance and a line capacitance of tens of pico-farads or more on a path from a data driver IC to an actual pixel. When a display system is driven at 60 Hz, it is possible to see that a line drive time is 1/(60*1440)=11.5 μs and a driving frequency is about 87 kHz. In other words, a display system with a QHD resolution may be simplified as 7680 driver circuits which charge and discharge 7680 capacitors of tens of pico-farads with a frequency of 87 kHz.

An active matrix LCD (AMLCD) is supplied with an alternating current (AC) signal based on a common electrode connected to a liquid crystal. In the frame inversion or line inversion method, a power source of a common electrode signal is changed between plus and minus with respect to the signal to exhibit the same characteristic as an AC signal. However, in practice, the capacitance of a common electrode is too high to be efficient in terms of power consumption. In the dot inversion method which is another driving method, an output of a column driver is driven higher or lower than a fixed common electrode signal to exhibit the same characteristic as an AC signal.

An active matrix OLED (AMOLED) display has no common electrode, and does not require an AC signal. Therefore, the power consumption of a column driver is larger than the power consumption of a column driver in an AMLCD, and it is difficult to reduce the power consumption with the existing data driver.

A power consumed by a capacitance may be calculated as $C*\{V_2^2-V_1^2\}*f*N$. When a capacitance is 50 pF, a total number of lines is 7680, a driving frequency is 87 kHz, $V_2$ is 7 V, and $V_1$ is 2 V, the calculated power consumption is about 1.5 [W]. These days, timing controllers are manufactured using a fine scale process, and thus have a power consumption of about 100 mW to 200 mW, so that, excluding the light source, a data driver consumes most of the power.

Since the above calculation is based on an assumption of the worst case, a power consumption is a probabilistic average in practice. However, due to the recent requirements of high picture quality and requirements for videos, the power consumption increases in portable devices such as a smart phone, a tablet personal computer (PC), and so on. In the case of the portable devices such as a smart phone and a tablet PC, the power consumed by a display is a considerable portion of the power consumed by. To increase a usage time, there is a need to minimize the power consumption of the display.

SUMMARY OF THE INVENTION

The present invention is directed to solving a problem of no retrieval of energy charged up in a panel when a data driver drives the panel, and one of the main aims of the invention is providing a data driver which may retrieve energy charged up in a data line by driving the data line with voltages from a start voltage to an end voltage through an intermediate voltage thereby reduce power consumption.

Another of the main aims of the present invention is providing a display panel capable of retrieving energy charged up in a data line and a display driving method capable of reducing power consumption by retrieving the energy charged up in a data line.

According to an aspect of the present invention, there is provided a data driver for driving a data line which is a capacitive load having one end electrically connected to a unit pixel, the data driver including an energy retrieving unit configured to drive the data line with at least one intermediate voltage by applying the at least one intermediate voltage to the data line and a data driving unit configured to finely tune a voltage and drive the data line with an end voltage. The energy retrieving unit retrieves energy charged up in the data line in stages by driving the data line with voltages from a start voltage to the end voltage through the at least one intermediate voltage.

According to another aspect of the present invention, there is provided a display including a display panel in which unit pixels driven by data lines and scan lines are disposed in an array, a scan driver configured to drive the scan lines and the unit pixels connected to the scan lines, and a data driver configured to drive the data lines and the unit pixels connected to the data lines. The data driver drives the data lines by providing electrical signals in stages to the data lines which are capacitive loads and retrieves energy from the data lines in stages.

According to another aspect of the present invention, there is provided a method of driving a display, the method including providing energy to a data line which is a capacitive load in the form of an electrical signal to drive the data line with a start voltage and driving the data line with voltages from the start voltage to an end voltage through an intermediate voltage and retrieving energy charged up in the data line.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
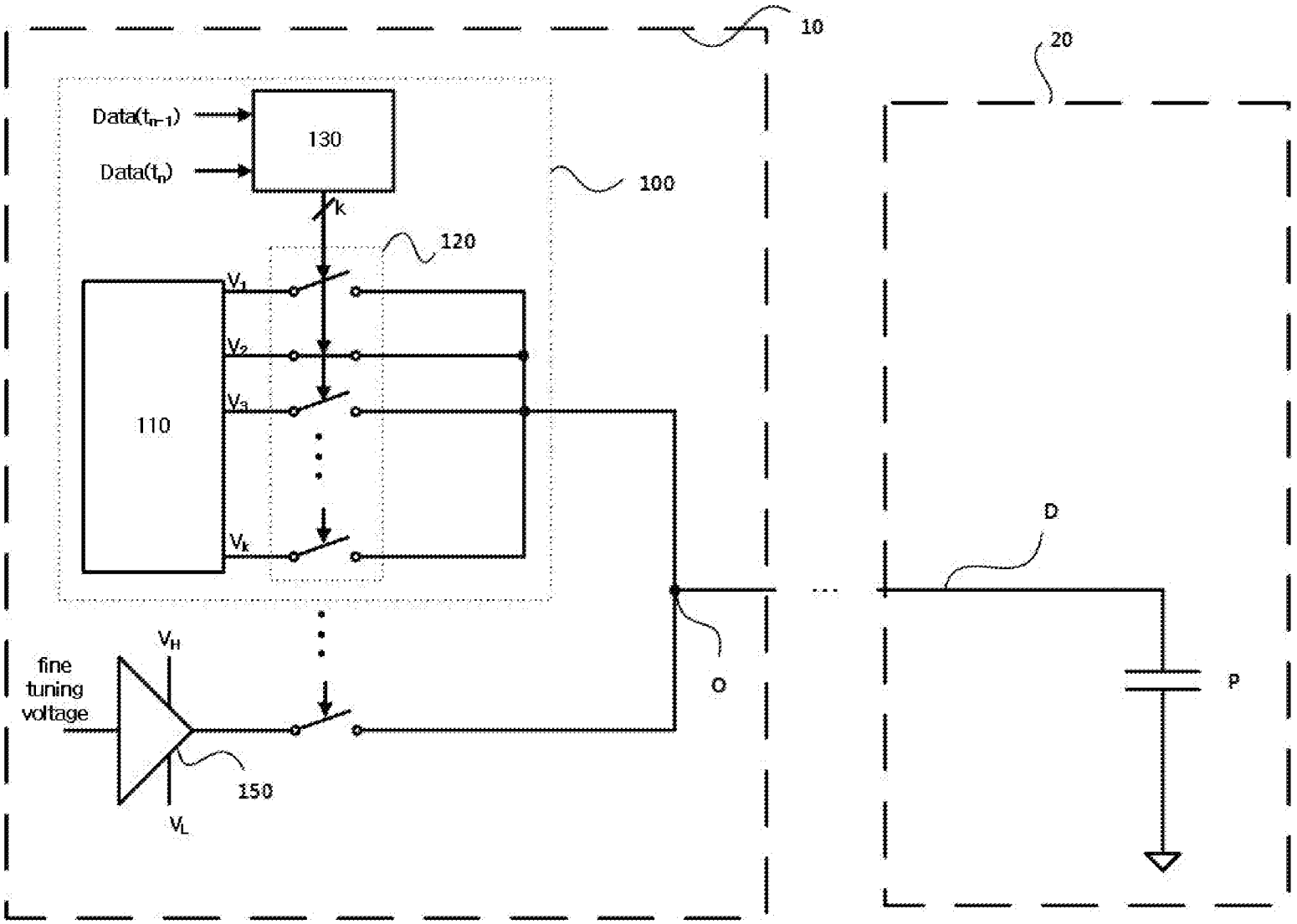
FIG. 1 is a block diagram schematically showing a display according to the present embodiment.

Specific structural and functional details disclosed herein are merely representative for purposes of describing the exemplary embodiments of the present invention, and the present invention should not be construed as limited to the exemplary embodiments. In other words, the present invention is susceptible to various modifications and alternative forms, and it will be understood that the scope of the present invention covers all modifications, equivalents, and alternatives capable of implementing the technical spirit of the present invention.

The terminology used in this specification should be understood as follows.

The terms "first," "second," etc. are used to distinguish one element from other elements, and the scope of the present invention should not be limited by these terms. For example, a first element may be termed a second element, and vice versa.

The singular forms "a," "an," and "the" are intended to include the plural forms as well unless the context clearly indicates otherwise. It will be further understood that the terms "comprises," "comprising," "includes," and "including," when used herein, specify the presence of stated features, integers, steps, operations, elements, parts, or combinations thereof, but do not preclude the presence or addition of one or more other features, integers, steps, operations, elements, parts, or combinations thereof.

It should also be noted that in some alternative implementations, the functions or operations noted in the blocks may occur out of the order noted in the flowcharts. In other words, the blocks shown in succession may be executed in the noted order, substantially concurrently, or in the reverse order The expression "and/or" used to describe exemplary embodiments of the present disclosure includes any and all combinations of one or more of the associated listed items.

In reference drawings for describing exemplary embodiments of the present disclosure, size, height, thickness, etc. are intentionally exaggerated for a convenience of description and an ease of understanding, and are not enlarged or reduced according to a ratio. Also, in the drawings, some elements may be intentionally reduced, and other elements may be intentionally enlarged.

Unless otherwise defined, all terms used herein have the same meaning as commonly understood by those of ordinary skill in the art to which this invention pertains. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a block diagram schematically showing a display according to the present embodiment. Referring to FIG. 1, the display according to the present embodiment includes a data driver 10 and a display panel 20 which displays an image.

The display panel 20 includes a plurality of unit pixels P which are disposed in an array and display an image, and the unit pixels are driven to display the image. In FIG. 1, the display panel 20 is shown to include only one unit pixel P. However, this is for a brief and clear description, and a plurality of pixels P are disposed in an array. The data driver 10 drives a data line D and the unit pixels P connected to the data line D. One end of the data line D is connected to an output node O of the data driver 10, and the other end is connected to switches included in the unit pixels P.

As an example, the display panel 20 may be a liquid crystal display (LCD) panel. The LCD panel includes liquid crystal, transparent electrodes sandwiching the liquid crystal, and a polarizer plate. When a voltage is applied to one pair of transparent electrodes, the arrangement of the liquid crystal between the transparent electrodes changes thereby transmitting or blocking light provided by a backlight unit disposed at the rear.

Figure 2A:
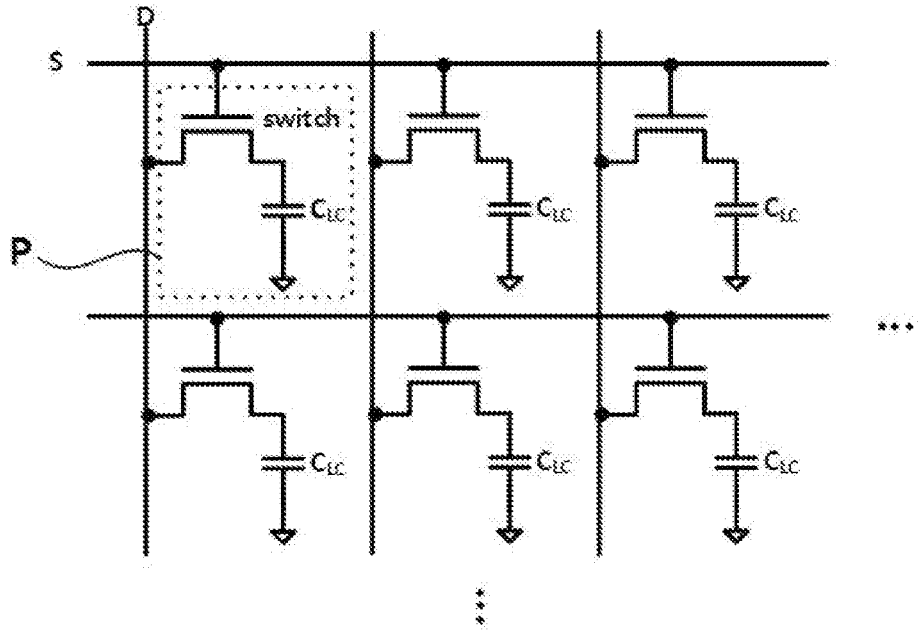
FIG. 2(A) is a schematic circuit diagram illustrating a unit pixel in a liquid crystal display (LCD)

As shown in FIG. 2(A), in each of the devices which display an image in the LCD display panel, a control end of a switch is driven by a scan line S, and a voltage corresponding to data to be displayed by a liquid crystal $C_{LC}$ is provided from a data line D through the switch.

As another example, the display panel 20 may be an organic light-emitting diode (OLED) panel. The OLED panel includes an electron transport layer which transport electrons between two electrodes, that is, a cathode and an anode, a hole transport layer which transports holes, and a light-emitting layer which emits light when the transported electrons and holes are combined. When a current is provided to the cathode and the anode, the cathode provides electrons which are transported to the light-emitting layer through the electron transport layer, and the anode provides holes which are transported to the light-emitting layer through the hole transport layer. The electrons and holes transported to the light-emitting layer recombine to emit light. Unlike an LCD which does not emit light by itself and instead transmits or blocks light provided from the rear, an OLED display emits light by itself with the provided energy. Instead of a backlight system required in an LCD, an OLED display requires a direct current (DC)-DC converter which may adjust brightness by directly supplying a current to an OLED device.

Figure 2B:
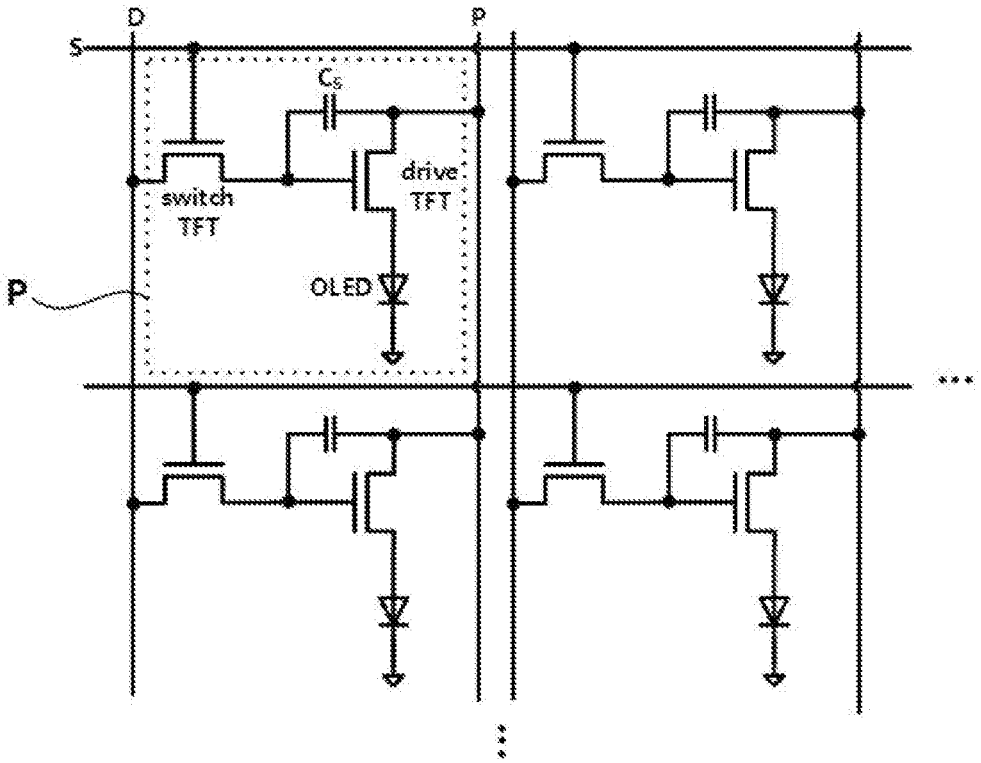
FIG. 2(B) is a schematic circuit diagram illustrating a unit pixel in an organic light-emitting diode (OLED) display.

As shown in FIG. 2(B), in each of devices which display an image in the OLED display panel, a control end of a switch thin film transistor (TFT) is driven by a scan line S, an electrical signal corresponding to data to be displayed by a liquid crystal $C_{LC}$ is provided from a data line D to a capacitor Cs through the switch TFT, and the capacitor Cs provides a voltage corresponding to the provided electrical signal to a control end of a drive TFT. One end and the other end of the drive TFT conduct electricity according to the voltage applied to the control end and provide a current to an OLED device, so that the OLED emits light.

Hereinafter, a unit pixel P is defined to include at least one switch which supplies or blocks energy to a unit device and a device which displays an image. In FIG. 2(A), a unit pixel P includes a switch which has a control end connected to a scan line S and one end connected to a data line D and provides energy to the liquid crystal $C_{LC}$ or blocks energy and the liquid crystal $C_{LC}$ which is a device for displaying an image. Although not shown in the drawing, a storage capacitor connected between the adjacent scan line S and the other end of the switch may also be included as a device for enabling the liquid crystal $C_{LC}$ to display an image.

In the OLED panel, a unit pixel P includes a switch TFT connected between a scan line and a data line, a drive TFT which drives an OLED, a capacitor Cs which provides a control voltage to a control end of the drive TFT, and the OLED which is a device for displaying an image. Although not shown in the drawing, other devices which function to display an image may be included in the unit pixel P.

Referring back to FIG. 1, the data line D is a conductive line, and connects the output node O of the data driver 10 and the unit pixels P. The data line D has a line capacitance with respect to a reference electric potential, and is a capacitive load from the viewpoint of the data driver 10. Therefore, to drive the unit pixels P, the data driver 10 is required to drive the data line D which is a capacitive load together with the unit pixels P, and the data line D is also charged with energy in the driving process.

Hereinafter, "driving a data line" does not only denote providing a voltage to the data line to make a voltage of the data line to reach a target voltage but also denotes providing a target voltage to unit pixels.

The data driver 10 includes an energy retrieving unit 100 which drives the data line D with a target intermediate voltage and a data driving unit 150 which finely tunes a voltage and provides the voltage to the data line D and the pixels P. The energy retrieving unit 100 includes a voltage generator 110 which outputs intermediate voltages $V_1$, $V_2$, $V_3$, . . . , and $V_k$, and a switch unit 120 including a plurality of switches which connect a plurality of intermediate voltages $V_1$, $V_2$, $V_3$, . . . , and $V_k$ generated by the voltage generator 110 to the output node O or block the intermediate voltages $V_1$, $V_2$, $V_3$, . . . , and $V_k$.

Figure 3A:
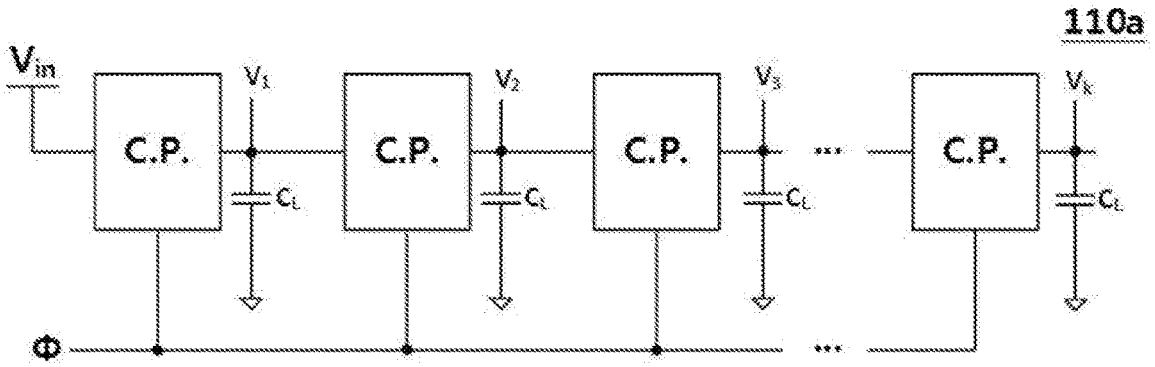
FIGS. 3(A) to 3(C) are diagrams schematically showing exemplary embodiments of a voltage generator.
Figure 3B:
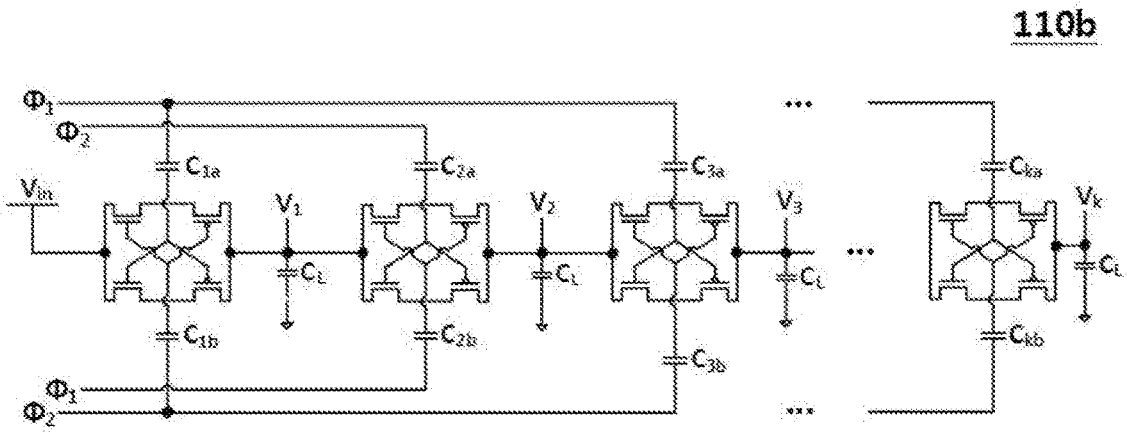
Figure 3C:
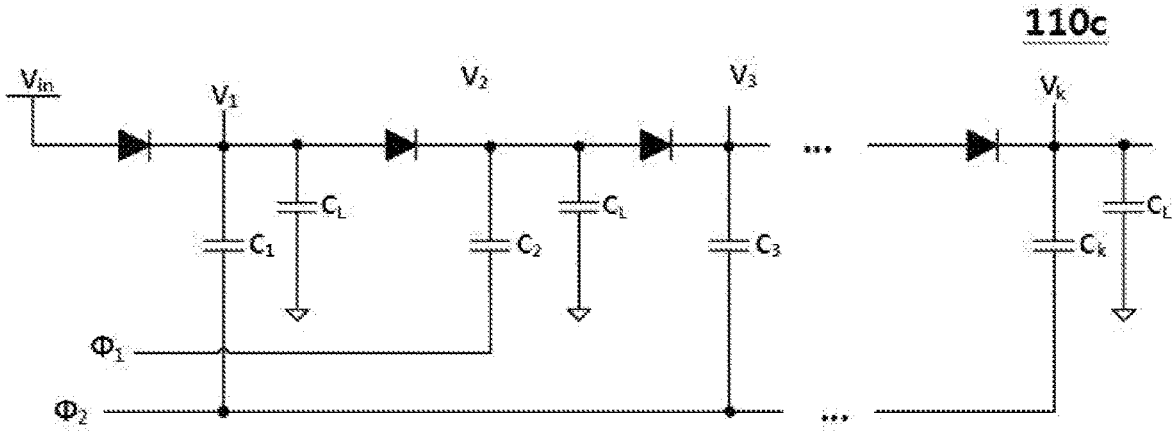

FIGS. 3(A) to 3(C) are diagrams schematically showing exemplary embodiments of a voltage generator 110 (see FIG. 1). Referring to FIG. 3(A), a voltage generator 110*a* may be implemented by connecting unit charge pump modules C.P. in cascade. Each of the charge pump modules C.P. is provided with an input voltage $V_{in}$ or an output voltage of a preceding charge pump module to store the provided voltage in an energy storage device and is supplied with energy in the form of an electrical signal to boost the provided voltage and output the boosted voltage.

As an example, the input voltage $V_{in}$ of a charge pump module may be a DC voltage which is provided by a battery or obtained by rectifying an alternating current (AC) voltage, or may be a DC voltage thereof output through a low-dropout voltage regulator. The electrical signal which supplies the energy to boost voltages provided to the charge pump modules C.P. may be a signal $\phi$ which is periodically provided.

Output capacitors $C_L$ connected to outputs of the respective charge pump modules C.P. connected in cascade may function as capacitors for energy retrieval which are provided with energy retrieved from a data line and charged. The output capacitors $C_L$ are provided with electric charge corresponding to a voltage charged up in the data line and store the electric charge therein, thereby retrieving the energy in the form of a voltage. Also, the output capacitors $C_L$ may function to improve current driving characteristics of the respective charge pump modules C.P. and to smooth output voltages.

In a voltage generator 110*b* shown in FIG. 3(B), respective charge pump modules store voltages which are provided as inputs to $C_{1a}$, $C_{2a}$, $C_{3a}$, . . . , and $C_{ka}$ and $C_{1b}$, $C_{2b}$, $C_{3b}$, . . . , and $C_{kb}$ varying in phase by a half period, boost the provided voltages with two signals $\phi_1$ and $\phi_2$ having opposite phases, and outputs the boosted voltages.

As described above, output capacitors $C_L$ function as capacitors for energy retrieval which retrieve energy charged up in the data line and pixels and store the retrieved energy. Also, when the respective charge pump modules operate at a high frequency, it is possible to smooth out ripples occurring in the output voltages and improve current driving characteristics.

A voltage generator 110*c* shown in FIG. 3(C) is an exemplary embodiment implemented using diodes. The voltage generator 110*c* also boosts a provided input voltage $V_{in}$ with two signals $\phi_1$ and $\phi_2$ having different phases and outputs the boosted input voltage.

Output capacitors $C_L$ function as capacitors for energy retrieval which retrieve energy charged in a data line and pixels and store the retrieved energy and may smooth out ripples occurring in output voltages and improve current driving characteristics.

For example, it is possible to assume a case in which charge is retrieved through $V_4$ but a voltage is lowered at $V_2$ due to a high current. At this point, the charge retrieved through the output capacitor of $V_4$ may move to $V_2$ through $V_3$ in the form of a current. In other words, when an excess or deficient charge occurs in the voltage generator 110*c*, charge may move therein, and a current flow provided by an input is minimized, so that energy consumption may be minimized.

Although not shown in the drawings, a voltage generator may be implemented by connecting a plurality of boost converter modules in cascade and connecting an output capacitor to an output of each of the boost converter modules. When a voltage generator is implemented with a plurality of boost converter modules connected in cascade, it is possible to output a plurality of voltages by boosting an input voltage and providing the boosted voltage as an input for the next boost converter module.

According to another exemplary embodiment not shown in the drawings, a voltage generator may be implemented by connecting an output capacitor to each of a plurality of buck converter modules which are connected in cascade. When a voltage generator is implemented by connecting a plurality of buck converter modules which are connected in cascade, an input voltage may be reduced and then provided to a next buck converter module, so that a plurality of voltages may be output.

According to the present embodiment, a predetermined die area may be required to form a voltage generator circuit for forming a plurality of intermediate voltages. However, the voltage generator circuit may be used as a circuit for generating a gamma reference signal, and thus it is possible to reduce an occupied area.

In an exemplary embodiment, it is assumed that a plurality of intermediate voltages $V_1, V_2, V_3, \ldots$, and $V_k$ provided by the voltage generator 110 satisfy $V_1<V_2<V_3<\ldots<V_k$. In case that the energy retrieving unit 100 intends to drive the data line D to $V_3$ from the previous data line voltage of $V_1$, a switch controller 130 (see FIG. 1) controls switches so that the data line D is first charged to $V_2$ from $V_1$, then the data line D is finally charged to $V_3$ from $V_2$. For example, the switch controller 130 controls a switch of the switch unit 120 to connect an output of $V_2$ of the voltage generator 110 to the output node O. When the data line D is driven with $V_2$, the switch controller 130 blocks the switch which connects the output of $V_2$ of the voltage generator 110 to the output node O and controls a switch to connect an output of $V_3$ of the voltage generator 110 to the output node O. Therefore, the energy retrieving unit 100 may drive the data line D with the target voltage $V_3$.

In another exemplary embodiment, when the energy retrieving unit 100 intends to drive the data line D to $V_1$ from the previous data line voltage of $V_3$, the switch controller 130 controls switches of the switch unit 120 so that the data line D is driven with $V_2$ and then $V_1$.

As will be described below, the energy retrieving unit 100 may retrieve energy charged up in the data line D in stages by sequentially driving the data line D from a start voltage to an end voltage through an intermediate voltage.

The switch controller 130 is shown to be included in the data driver 10, but the drawing merely shows an exemplary embodiment. According to another exemplary embodiment, the switch controller 130 is included in a timing controller (not shown), and switch control signals and a switch array control signal (see $V_{SW}$ in FIG. 4) to be described below may be provided as additional data together with pixel data from the timing controller using a high-speed serial interface or an interface including a low voltage differential signaling (LVDS) interface, a mini-LVDS interface, etc.

In an exemplary embodiment, when the switch controller 130 is disposed in the data driver 10, the switch controller 130 compares a previous data line voltage which is a start voltage with a current target driving voltage of the data line D which is an end voltage and controls a switch driving sequence. In another exemplary embodiment, when the switch controller 130 is disposed in a timing controller (not shown), the switch controller 130 may beforehand analyze data of an image to be displayed and provide a switch driving sequence to the data driver 10 as an additional signal together with a data signal.

The data driving unit 150 provides an additional voltage required to be provided after the voltage generator 110 drives the data line D. For example, it is assumed that $V_1$ is 1 V, $V_2$ is 2 V, $V_3$ is 3 V, a voltage to be provided to a unit pixel P is 3.7 V, and the data line D is charged to 1 V which is a voltage corresponding to $V_1$. The energy retrieving unit 100 sequentially drives the data line D with 2 V and then 3 V. The data driving unit 150 is provided with a fine tuning voltage and provides 3.7 V to the data line D already precharged to 3 V, thereby applying the target voltage to the unit pixel P and enabling the unit pixel P to express a target gradation.

Figure 4:
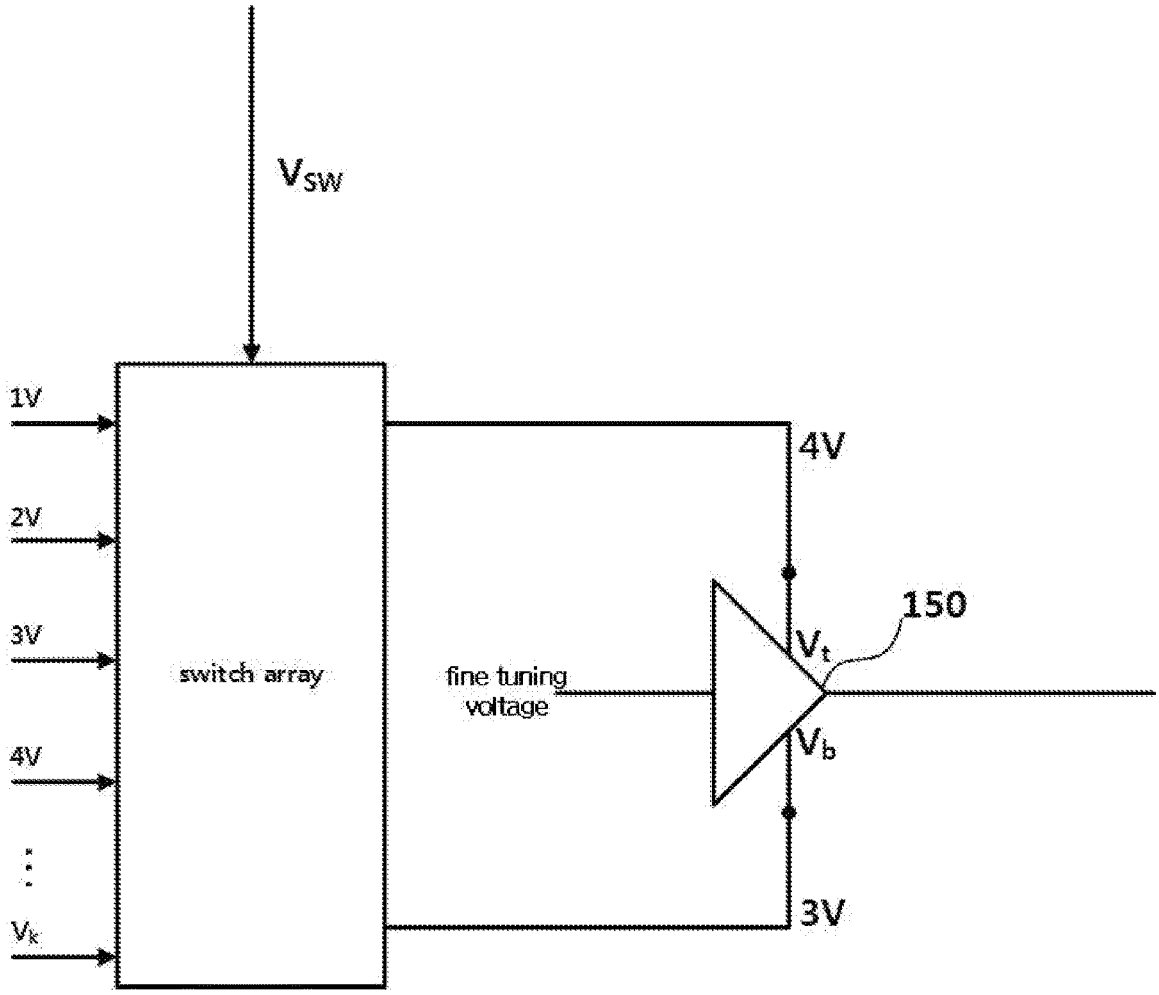
FIG. 4 is a block diagram illustrating a data driving unit.

FIG. 4 is an exemplary block diagram illustrating the data driving unit 150. Referring to FIG. 4, the data driving unit 150 is provided with a fine tuning voltage and outputs an end voltage. The fine tuning voltage is provided to the data driving unit 150 in the form of an analog voltage formed by a gamma reference signal and input data bits. The data driving unit 150 may include an offset compensation circuit to drive the data line D with a target end voltage.

An existing data driving unit should output all voltages to be provided to pixels. For example, when pixels operate between 0 V and 10 V, the data driving unit should output voltages between 0 V and 10 V. In this case, channel width and line width increase to withstand high voltage, and thus the size of a device increases.

However, according to the present embodiment, when $V_1$ which is any one of intermediate voltage levels with which the energy retrieving unit 100 drives the data line D is provided as a top voltage $V_t$ of the data driving unit 150 and $V_j$ which is any one of intermediate voltage levels with which the energy retrieving unit 100 drives the data line D is provided as a bottom voltage $V_b$ of the data driving unit 150, it is possible to implement the data driving unit 150 not using high-voltage devices.

As an example, when the data driving unit 150 intends to drive the data line D to 3.5 V which is precharged to 3 V by the energy retrieving unit 100 as shown in FIG. 4, the switch controller 130 controls the switch array so that 3 V which is equal to a precharged voltage of the data line D is applied as the bottom voltage $V_b$ of the data driving unit 150 and 4 V which is close to and higher than 3 V is applied as the top voltage $V_t$ of the data driving unit 150. Subsequently, the data driving unit 150 may be provided with a fine tuning voltage and may output 3.5 V which is the target voltage.

As another example, when the data driving unit 150 intends to drive the data line D which is precharged to 4 V by the energy retrieving unit 100 with 3.5 V, the switch controller 130 controls the switch array so that 4 V which is equal to a precharged voltage of the data line D is applied as the top voltage $V_t$ of the data driving unit 150 and 3 V which is close to and lower than 4 V is applied as the bottom voltage $V_b$ of the data driving unit 150. Subsequently, the data driving unit 150 may be provided with a fine tuning voltage and may output 3.5 V which is the target voltage.

In an exemplary embodiment, voltages provided as the top voltage $V_t$ and the bottom voltage $V_b$ of the data driving unit 150 are voltages close to each other among voltages output by the energy retrieving unit 100. For example, when the data driving unit 150 intends to drive the data line D with an end voltage of 3.5 V as shown in FIG. 4, 4 V may be provided as the top voltage $V_t$, and 3 V may be provided as the bottom voltage $V_b$.

When voltages close to each other among voltages output by the energy retrieving unit 100 are applied as the top voltage $V_t$ and the bottom voltage $V_b$ of the data driving unit 150, it is possible to design the data driving unit 150 not using high-voltage devices to withstand high voltage, and thus it is possible to reduce a die area required to form the data driving unit 150. Further, since the voltage difference between the top voltage $V_t$ and the bottom voltage $V_b$ of the data driving unit 150 decreases, it is possible to reduce power consumption.

In another exemplary embodiment not shown in the drawings, voltages provided as the top voltage $V_t$ and the bottom voltage $V_b$ of the data driving unit 150 among voltages output by the energy retrieving unit 100 may not be voltages close to each other. When the data driving unit 150 intends to drive the data line D with an end voltage of 3.5 V, 5 V may be provided as the top voltage $V_t$ and 2 V may be provided as the bottom voltage $V_b$, so that enough output margin is provided to the output voltage of the data driving unit 150.

The data driving unit 150 may be implemented as described in the exemplary embodiments described above, and it is also possible to implement the data driving unit 150 so that a top voltage and a bottom voltage are applied according to the related art. The present embodiment is not limited by the configuration of the data driving unit 150.

In the above exemplary embodiments, a voltage provided as a top voltage of the data driving unit 150 may be higher than the maximum voltage of each channel output in the source driver IC, and a voltage provided as a bottom voltage may be lower than the minimum voltage of each channel output in the source driver IC, so that an end voltage may be provided within a range from the top voltage to the bottom voltage.

For example, while a charge transfer is occurring between the voltage generator 110 and the data line D, the output of the data driving unit 150 may be precharged to a final voltage to reduce a total line charging and discharging time. In another example, to reduce power consumption of the data driving unit 150, the output of the data driving unit 150 is precharged to a final voltage after the charge transfer between the voltage generator 110 and the data line D is finished.

According to an exemplary embodiment, the data driving unit 150 does not require a high-voltage transistor having a large area and capable of withstanding high voltage, and thus may economically implement a data driving unit in a smaller area than the related art. Further, according to the related art, when a current required to drive a data driving unit is 1 μA, a top voltage $V_t$ is 10 V, and a bottom voltage $V_b$ s 0 V, a power consumed by a total of 7680 data driving units is 76.8 mW. On the other hand, since 1 V is applied between the top voltage and the bottom voltage of data driving units as shown in the exemplary embodiment of FIG. 4, a power consumed by the data driving units is calculated to be 7.68 mW, which is 10% of the related art. Therefore, it is possible to reduce power consumption of the data driving units.

Figure 5:
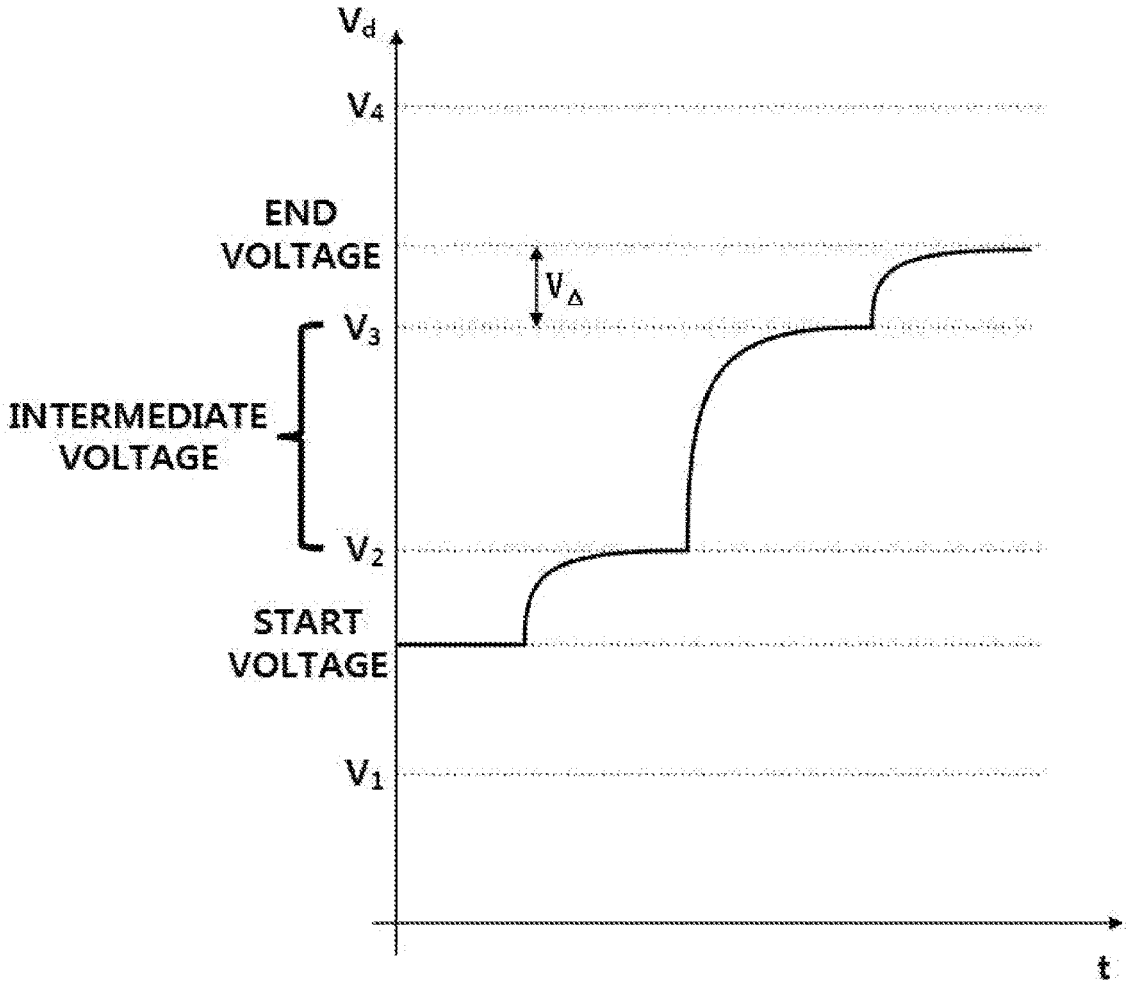
FIG. 5 is a graph showing an electric potential of a data line rising in stages.
Figure 6:
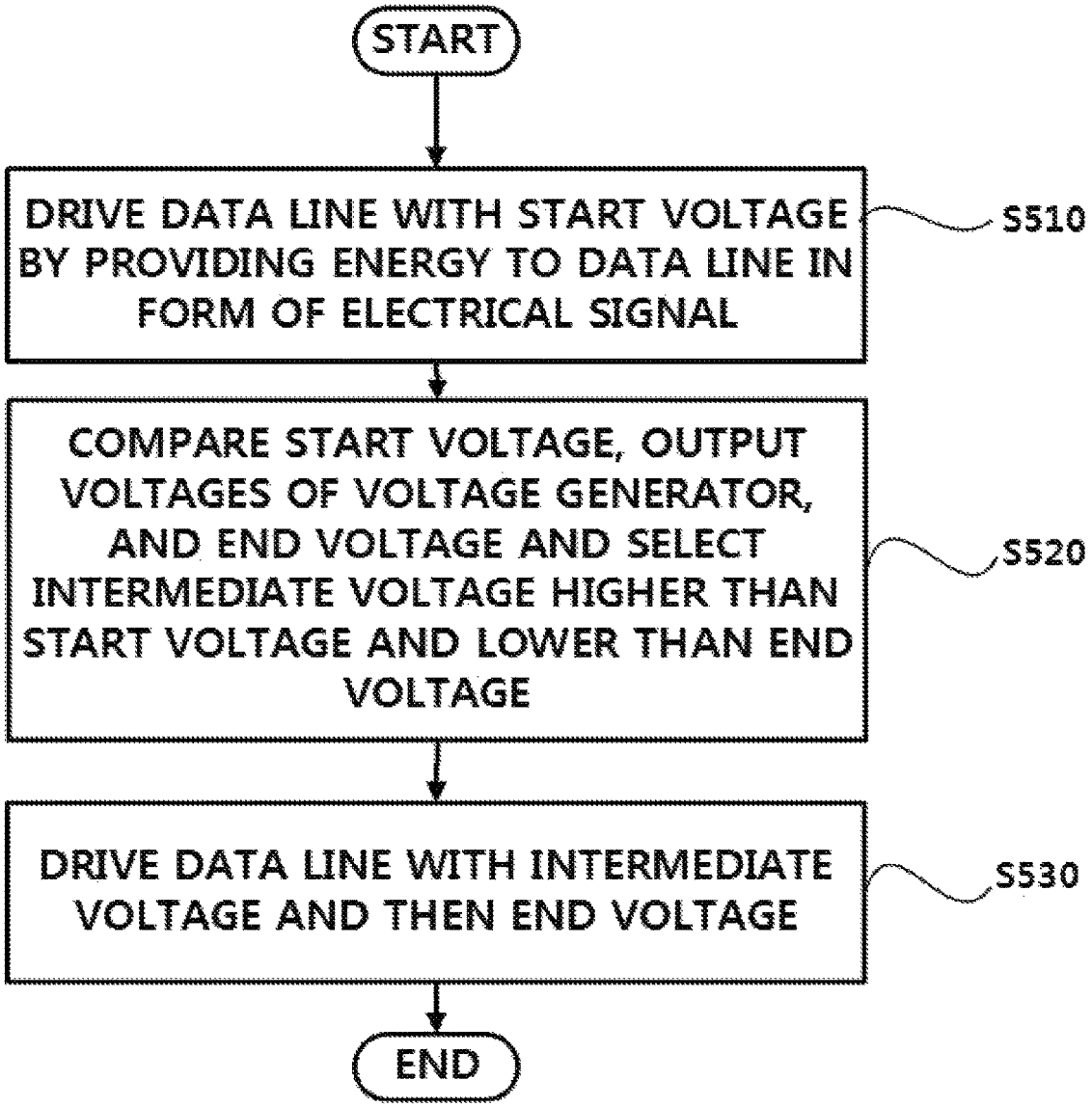
FIG. 6 is a flowchart schematically illustrating an example of a method of driving a display according to the present embodiment.

An exemplary embodiment of a method in which a data driver drives a data line when an end voltage is higher than a start voltage will be described with reference to accompanying drawings. FIG. 5 is a graph showing an electric potential of a data line rising in stages. FIG. 6 is a flowchart schematically illustrating an exemplary embodiment of a method in which a data driver drives a unit pixel when a voltage to be provided to the unit pixel through a data line D is higher than a voltage charged up in the data line D. For a brief and clear description, the voltage charged up in the data line D is referred to as a start voltage below, and a voltage for driving the data line D is referred to as an end voltage. However, these are not for limiting the scope of the present invention but are for briefly and clearly indicating the voltages by simplifying their terms.

Referring to FIGS. 5 and 6, an energy retrieving unit drives a data line with a start voltage by providing a voltage to the data line (S510). This operation in which the data line is driven with the start voltage is the operation in which a data driver drives the previously driven data line with a target end voltage. In the present embodiment, the data line is driven with a voltage higher than a voltage charged up in the data line as shown in FIG. 5. In the driving process, energy is charged up in the data line.

A switch controller compares the start voltage with $V_1$, $V_2$, $V_3$, . . . , and $V_k$ which are output voltages of a voltage generator (see 110 in FIG. 1) and selects intermediate voltages higher than the start voltage and lower than an end voltage (S520). As shown in FIG. 5, $V_2$ and $V_3$ are higher than the start voltage and lower than the end voltage. Therefore, it is possible to select $V_2$ and $V_3$ as intermediate voltages. In another exemplary embodiment different from the present embodiment, there may be one intermediate voltage. The switch controller controls a switch unit to connect the data line to the intermediate voltages which are outputs of the voltage generator, thereby driving the data line from the start voltage to the intermediate voltages. For example, when there is a plurality of intermediate voltages as shown in FIG. 5, the switch controller controls the switch unit so that the lower intermediate voltage $V_2$ and the higher intermediate voltage $V_3$ are sequentially applied to the data line. When the intermediate voltages are provided to the data line, a voltage $V_d$ of the data line is exponentially close to the intermediate voltages by resistance components and capacitance components of the data line and the pixels as shown in the drawing.

In an exemplary embodiment, the switch controller compares a previous data line voltage which is the start voltage with a current target driving voltage of the data line which is the end voltage, and controls a switch driving sequence. In another exemplary embodiment, the switch controller may beforehand analyze data of an image to be displayed to control switches.

A data driving unit drives the data line with the end voltage (S530). The intermediate voltages selected in operation S520 are provided to the data line in order from low to high voltages. Therefore, the voltage of the data line before being driven with the end voltage is same as the highest intermediate voltage among the selected intermediate voltages. Since the voltage with which the data line has been driven may differ from the end voltage to be provided to the pixels, the data driving unit drives the data line with the end voltage. In an exemplary embodiment, the data driving unit is provided with a fine tuning voltage which is an analog voltage formed by a gamma reference signal, digital-to-analog converter controlled by input data bits. The data line is charged with this accurate end voltage to drive the data line with the desired display information.

For example, when the data line is driven with $V_2$ and then $V_3$ which are the intermediate voltages, the data line is kept at the voltage $V_3$. $V_3$ may be connected to a bottom voltage of the data driving unit, and $V_4$ may be connected to a top voltage. The data driving unit is provided with the fine tuning voltage, boosts a data line voltage by VA to generate an accurate end voltage to drive the data line.

Figure 7:
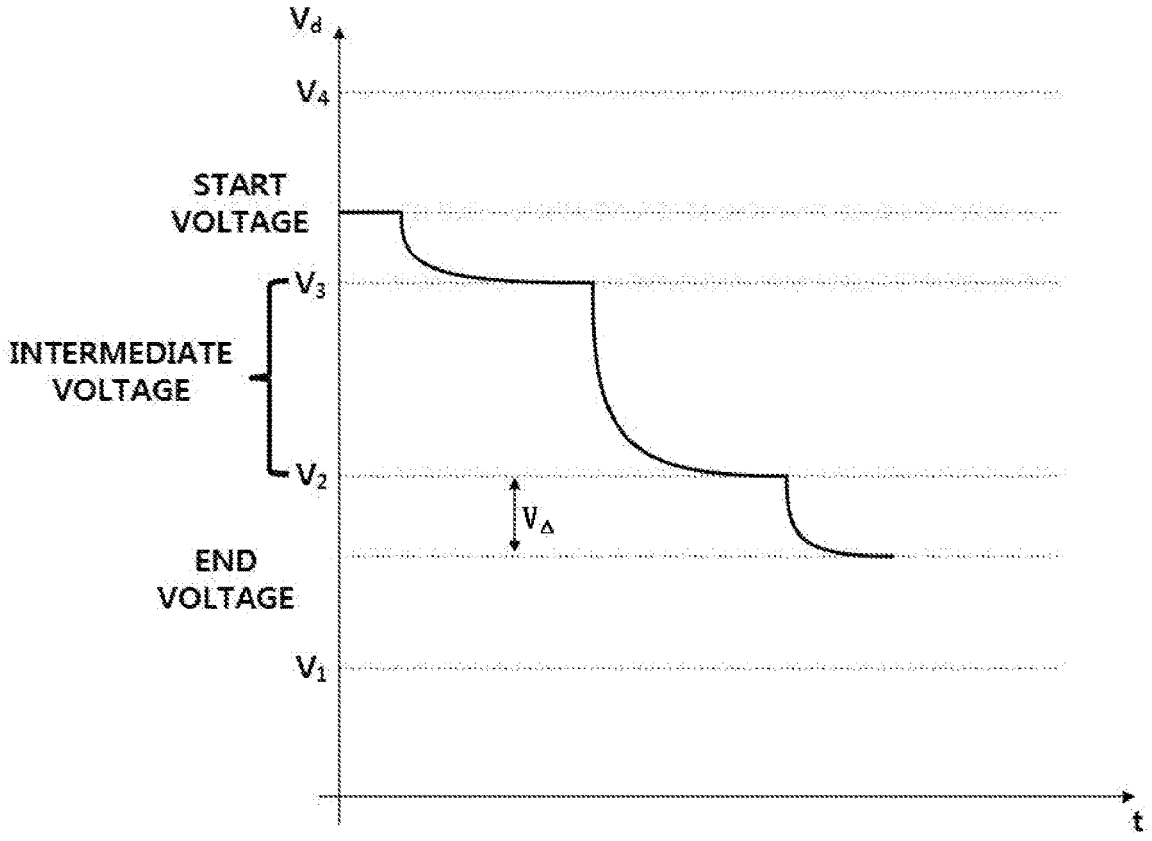
FIG. 7 is a graph showing an electric potential of a data line falling in stages.
Figure 8:
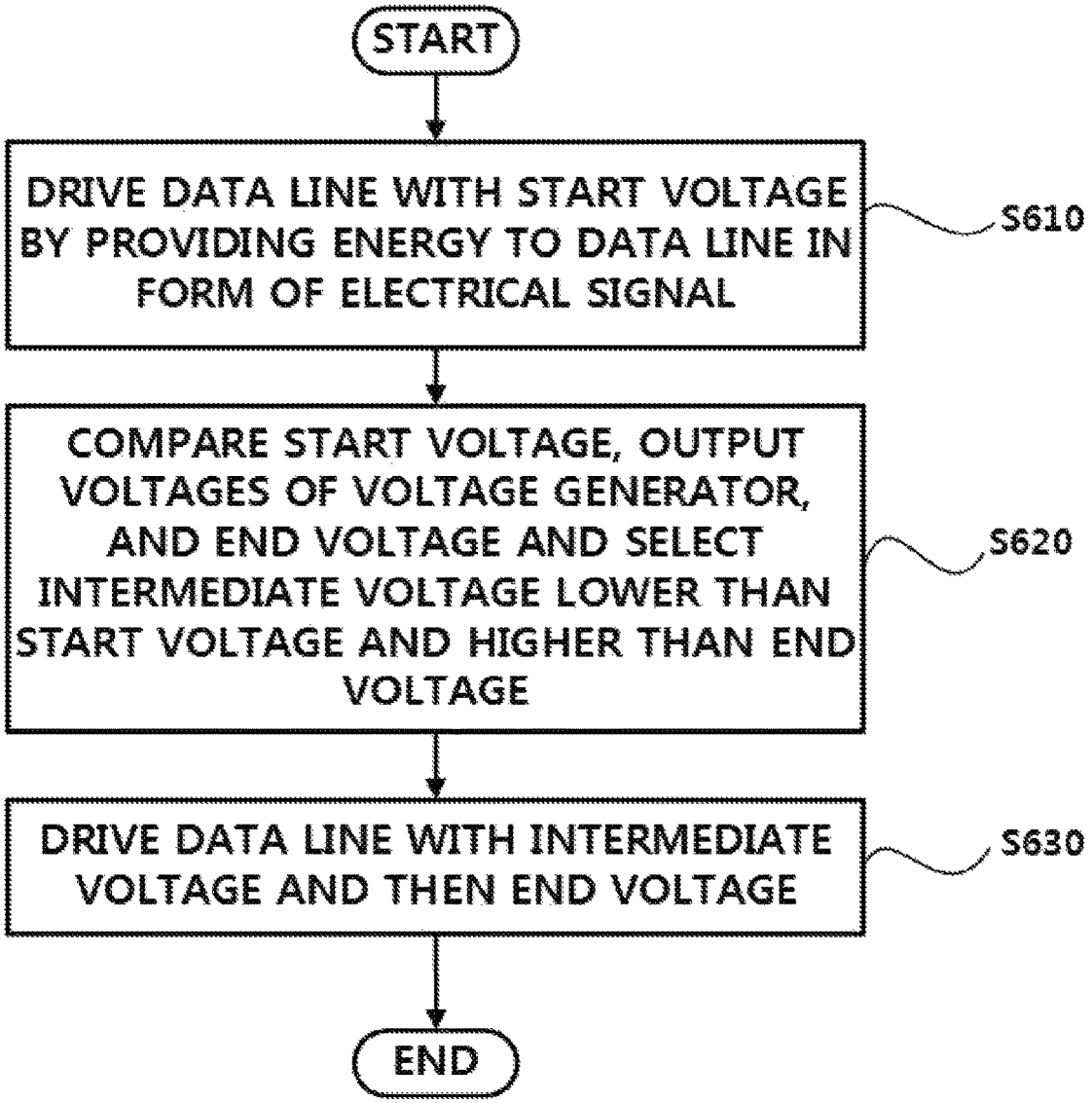
FIG. 8 is a flowchart schematically illustrating another example of a method of driving a display according to the present embodiment.

An exemplary embodiment in which a data driver drives a data line when a start voltage is higher than an end voltage will be described below with reference to FIGS. 7 and 8. FIG. 7 is a graph showing an electric potential of a data line falling in stages. FIG. 8 is a flowchart schematically illustrating an exemplary embodiment of a method in which a data driver drives a unit pixel when an end voltage which is a voltage to be provided to the unit pixel through a data line is lower than a start voltage which is a voltage charged up in the data line D.

Referring to FIGS. 7 and 8, an energy retrieving unit drives a data line with a start voltage by providing a voltage to the data line (S610). This operation in which the data line is driven with the start voltage is the operation in which a data driver drives the previously driven data line with a target end voltage.

A switch controller compares the start voltage with $V_1$, $V_2$, $V_3$, . . . , and $V_k$ which are output voltages of a voltage generator (see 110 in FIG. 1) and selects intermediate voltages lower than the start voltage and higher than an end voltage (S620). For example, as shown in FIG. 7, $V_3$ and $V_2$ are lower than the start voltage and higher than the end voltage. Therefore, the switch controller may select $V_3$ and $V_2$ as intermediate values. In another exemplary embodiment not shown in the drawings, when the start voltage is higher than $V_2$ and lower than $V_3$, there may be one intermediate voltage $V_2$.

In an exemplary embodiment, the switch controller compares a previous data line voltage which is the start voltage with a current target driving voltage of the data line which is the end voltage and controls a switch driving sequence. In another exemplary embodiment, the switch controller may beforehand analyze data of an image to be displayed to control switches.

The switch controller controls a switch unit to connect the data line to the intermediate voltages which are outputs of the voltage generator thereby driving the data line from the start voltage to the intermediate voltages. For example, when there is a plurality of intermediate voltages as shown in FIG. 7, the switch controller controls the switch unit, so that the higher intermediate voltage $V_3$ and the lower intermediate voltage $V_2$ sequentially drive the data line. When the intermediate voltages are provided to the data line, an electric potential $V_d$ of the data line is exponentially close to the intermediate voltages by resistance components and capacitance components of the data line and the pixels as shown in the drawing.

The data line and the pixels are capacitive loads as mentioned above. A capacitive load has a characteristic of storing energy in the form of a voltage generated by accumulated charge. Theoretically, there is no energy loss in a process in which the data driver boosts voltages of the data line and the pixels to drive the data line and the pixels. However, when a voltage is reduced by draining charge accumulated in a capacitive load to a reference potential, there is a loss of the energy accumulated in the capacitive load.

According to the present embodiment, energy accumulated in the data line is not drained to the reference potential or ground but is charged in an output capacitor of a voltage generator which outputs an intermediate voltage. Therefore, energy used by the voltage generator to boost a voltage of the data line is retrieved by the voltage generator.

Unlike the present invention which provides intermediate voltages to a data line in a process of retrieving energy, related art disclosed in the theses "A multi-level multi-phase charge-recycling method for low-power AMLCD column drivers" (IEEE Journal of Solid-State Circuits. Vol. 35, No. 1, January 2000) and "A TFT-LCD source-driver IC with charge-recycling technique" (Analog Integr Circ Sig Process, DOI 10.1007/s10470-010-9517-1) provide an isolation phase in which an electrical connection between a column line and a column driver is cut, and after the isolation phase, column lines having charged up voltages of the same polarity or column lines driven with a voltage having the same most significant bit (MSB) as a polarity are connected to the same capacitor to collect charge.

In addition, in the present embodiment, an energy retrieval operation or an energy providing operation is performed according to a magnitude relationship between a start voltage charged up in the data line and an end voltage for driving the data line, while, in the aforementioned documents, all electric charge charged up in each column line is collected to form a common voltage Vcom in every column line, and the column lines are driven by a dot inversion method. Therefore, there is a difference in the driving method between the present embodiment and the aforementioned documents.

Further, while an existing charge retrieval method requires a large signal difference between adjacent lines or between a driven column line and a column line to be driven next, the present embodiment does not have such a constraint. Therefore, the present embodiment may be used for any display driving method and is not limited to an LCD driven by the dot inversion method in the aforementioned documents.

Referring back to FIGS. 7 and 8, power consumed by a capacitor which is switched at a frequency f between a first voltage and a second voltage and flows all energy corresponding to a difference between the first voltage and the second voltage to a reference potential is calculated as $C*\{V_2^2-V_1^2\}*f$. For example, according to the related art, when a start voltage is 7 V, an end voltage is 3 V, and a data line having an equivalent capacitance $C_d$ is driven, $C_d*40*f$ [W] of power is consumed. However, according to the present embodiment, when a voltage of a data line falls sequentially from 7 V to an intermediate voltage of 6 V, from 6 V to an intermediate voltage of 5V and from 5V to another intermediate voltage of 4 V, there is neither an energy loss nor a power loss except the power consumption required for operation of a switch controller.

However, there is energy loss in a process in which the voltage of the data line falls from 4 V to an end voltage of 3 V because there is no intermediate voltage for retrieving energy. It is possible to see that the corresponding power consumption is Ca*7*f[W], which is only about 20% of the power consumption of the related art.

By reducing the interval between intermediate voltages, it is possible to increase energy retrieval efficiency. For example, it is assumed that intermediate voltages are 4 V and 2 V, that is, have a difference of 2 V, and the voltage of the data line falls from 5 V to 2.5 V. When the voltage of the data line falls from 5 V to 4 V, it is possible to retrieve energy. However, in a process in which the voltage of the data line falls from 4 V to 2.5 V, there is no intermediate voltage, and it is not possible to retrieve energy. The corresponding power consumption is $C_d*9.75*f$[W].

On the other hand, assuming that intermediate voltages are 5 V, 4 V, 3 V, and 2 V, that is, have a difference of 1 V, when the voltage of the data line falls from 5 V to 3 V through the intermediate voltage of 4 V, it is possible to retrieve energy. When the voltage of the data line falls from 3 V to 2.5 V, there is power loss, and the corresponding power consumption is $C_d*2.75*f$[W].

In other words, by reducing a difference between intermediate voltages, it is possible to minimize a loss of energy which is charged up in the data line and then wasted. However, when a difference between intermediate voltages is reduced, while it is possible to increase energy retrieval efficiency, an area required to implement the data driver increases. Therefore, it is necessary to design intermediate voltages with considerations given to the energy retrieval efficiency and the die area.

A data driving unit drives the data line with the end voltage (S630). The intermediate voltages selected in operation S610 are provided to the data line in order from high to low voltages. Therefore, the voltage of the data line is same as the lowest intermediate voltage among the selected intermediate voltages. Since the current voltage of the data line may differ from the end voltage to be provided to the pixels, the data driving unit drives the data line to provide the end voltage to the pixels. For example, when the data line is driven with $V_2$ after the intermediate voltage $V_3$ is provided to the data line, the data line is kept at the voltage $V_2$. $V_1$ may be connected to a bottom voltage of the data driving unit, and $V_2$ may be connected to a top voltage. The data driving unit may be provided with a voltage $V_\Delta$ corresponding to a difference between the end voltage and the data line voltage and may drive the data line with the end voltage which is a target voltage by providing the voltage $V_\Delta$ to the data line.

According to the present embodiment, a voltage generator provides a plurality of intermediate voltages, and a plurality of intermediate voltages are sequentially provided to a data line to retrieve energy consumed to charge a capacitive load. Also, an active matrix OLED (AMOLED) does not have the specific systematic requirements of methods such as the dot inversion method.

In exemplary embodiments of the present invention, a control operation for charge retrieving switches is performed according to a magnitude difference or relationship between a previous data line driving voltage and a current data line driving voltage, and a voltage difference between adjacent lines or between a start voltage and an end voltage is not required to be a predetermined level or higher. Accordingly, it is possible to use exemplary embodiments of the present invention for any display driving method.

Also, a voltage generator circuit for forming a plurality of intermediate voltages may be used as a circuit for generating a gamma signal, and thus it is possible to reduce the area occupied by an additional circuit in a process of forming an integrated circuit (IC). Further, unlike the related art, it is possible to implement a data driving unit not using high-voltage devices required to withstand high voltage, and thus exemplary embodiments of the present invention are advantageous in terms of die area.

According to the present embodiment, by driving a data line with voltages from a start voltage to an end voltage through an intermediate voltage, it is possible to retrieve energy charged up in the data line.

It will be apparent to those skilled in the art that various modifications can be made to the above-described exemplary embodiments of the present invention without departing from the spirit or scope of the invention. Thus, it is intended that the present invention covers all such modifications provided they come within the scope of the appended claims and their equivalents.

What is claimed is:

1. A data driver for driving a data line which is a capacitive load having one end electrically connected to a unit pixel, the data driver comprising:

circuitry configured to:

drive the data line with at least one intermediate voltage by applying the at least one intermediate voltage to the data line via an energy retrieving unit; and finely tune a voltage and drive the data line with an end voltage via a data driving unit, wherein the energy retrieving unit retrieves energy charged up in the data line in stages by driving the data line with voltages from a start voltage to the end voltage through the at least one intermediate voltage, wherein the energy retrieving unit includes:

a first plurality of intermediate voltage output modules, each intermediate voltage output module of the first plurality of intermediate voltage output modules; comprises a pair of capacitors, two pairs of a NMOS transistor and PMOS transistor, wherein a source of the NMOS transistor is connected to a source of the PMOS transistor in each of the two pairs, drains of the NMOS transistors are connected to form an input node, drains of the PMOS transistors are connected to form an output node, a gate of the NMOS transistor is connected to a gate of the PMOS transistor in each of the two pairs, and two signals having opposite phases are provided to the gates of each of the two pairs, and an output capacitor connected to the output node, wherein each intermediate voltage output module of the first plurality of intermediate voltage output modules stores voltages which are provided as inputs to a respective pair of capacitors, and wherein the energy charged up in the data line is retrieved and stored in the output capacitor connected to the output node.

2. The data driver of claim 1, wherein the at least one intermediate voltage is lower than the start voltage and higher than the end voltage.

3. The data driver of claim 1, wherein, when the data line is driven with a plurality of intermediate voltages output by the first plurality of intermediate voltage output modules, the retrieved energy is charged in the output capacitor connected to a respective output node of the first plurality of intermediate voltage output modules.

4. The data driver of claim 1, wherein the energy retrieving unit further includes:

a switch unit including a plurality of switches configured to connect the first plurality of intermediate voltage output modules to an output of the data driver or block the first plurality of intermediate voltage output modules;

a data driver output switch configured to connect an output of the data driving unit to the output of the data driver or block the output of the data driving unit; and a switch controller configured to control the data driver output switch and the plurality of switches included in the switch unit.

5. The data driver of claim 4, wherein the switch controller is disposed inside or outside the data driver to control the switch unit and the data driver output switch.

6. The data driver of claim 1, wherein the data driving unit receives a fine tuning voltage and drives the data line to reach the end voltage.

7. The data driver of claim 1, wherein the unit pixel is any one of a liquid crystal display (LCD) unit pixel and an organic light-emitting diode (OLED) unit pixel.

8. The data driver of claim 1, wherein, when a voltage charged up in the data line is higher than a voltage to be applied to the data line, the data driver retrieves the energy charged up in the data line.

9. A display comprising:

a display panel in which unit pixels driven by data lines and scan lines are disposed in an array;

a scan driver configured to drive the scan lines and the unit pixels connected to the scan lines; and a data driver configured to drive one line of the data lines and unit pixels connected to the one line, wherein the data driver drives the one line by providing electrical signals in stages to the one line which are capacitive loads, and retrieves energy from the one line in stages, wherein the data driver includes circuitry configured to drive the one line with voltages from a start voltage to an end voltage through at least one intermediate voltage and retrieve energy charged up in the one line in stages via an energy retrieving unit, wherein the energy retrieving unit includes:

a first plurality of intermediate voltage output modules, each intermediate voltage output module of the first plurality of intermediate voltage output modules comprises a pair of capacitors, two pairs of a NMOS transistor and a PMOS transistor, wherein a source of the NMOS transistor is connected to a source of the PMOS transistor in each of the two pairs, drains of the NMOS transistors are connected to form an input node, drains of the PMOS transistors are connected to form an output node, a gate of the NMOS transistor is connected to a gate of the PMOS transistor in each of the two pairs, and two signals having opposite phases are provided to the gates of each of the two pairs, and an output capacitor connected to the output node, wherein each intermediate voltage output module of the first plurality of intermediate voltage output modules stores voltages which are provided as inputs to a respective pair of capacitors, and wherein the energy charged up in the data line is retrieved and stored in the first plurality of output capacitor connected to the output node.

10. The display of claim 9, wherein the at least one intermediate voltage is lower than the start voltage and higher than the end voltage.

11. The display of claim 10, wherein, when a voltage charged up in the one line is higher than a voltage to be applied to the one line, the data driver retrieves the energy charged up in the one line.

12. The display of claim 9, wherein the energy retrieving unit further includes:

a switch unit including a plurality of switches configured to connect the first plurality of intermediate voltage output modules to an output of the data driver or block the first plurality of intermediate voltage output modules; and a switch controller configured to control the plurality of switches included in the switch unit.

13. The display of claim 12, wherein the switch controller drives the one line with the at least one intermediate voltage by controlling the switch unit to electrically connect the one line to any one of the first plurality of intermediate voltage output modules, and the energy charged up in the one line is charged to an output capacitor connected to an output of any one of the first plurality of intermediate voltage output modules.

14. The display of claim 9, wherein, while driving the one line with any one of the at least one intermediate voltage, the data driver charges the energy charged up in the one line to an output capacitor connected to an output of at least one intermediate voltage output module of the first plurality of intermediate voltage output modules.

15. The display of claim 9, wherein the circuitry is further configured to receive a fine tuning voltage and drive the one line with the end voltage via a data driving unit.

16. The display of claim 9, wherein the display panel is any one of a liquid crystal display (LCD) panel and an organic light-emitting diode (OLED) display panel.

* * * * *